US005592936A

United States Patent [19]

Thomas, Jr. et al.

[11] Patent Number: 5,592,936

[45] Date of Patent: Jan. 14, 1997

[54] SURGICAL HELMET

[75] Inventors: Ron Thomas, Jr., Alta Loma; Roger G. Ignon, Palos Verdes Estates; William Cohen, Long Beach, all of Calif.

[73] Assignee: Stackhouse, Inc., Palm Springs, Calif.

[21] Appl. No.: 519,721

[22] Filed: Aug. 28, 1995

[51] Int. Cl.[6] ..... A62B 7/10

[52] U.S. Cl. ..... 128/206.12; 128/201.25; 128/201.24; 2/171.3

[58] Field of Search ..... 128/201.22, 201.23, 128/201.25, 201.29, 205.29, 204.18, 206.28, 201.24, 857, 202.13; 2/418, 171.3

[56] References Cited

U.S. PATENT DOCUMENTS

| | | | |
|---|---|---|---|
| 3,822,698 | 7/1974 | Guy | 128/201.25 |
| 3,963,021 | 6/1976 | Bancroft | 128/201.25 |
| 4,227,520 | 10/1980 | Lord | 128/201.24 |
| 4,280,491 | 7/1981 | Berg et al. | 128/201.24 |
| 4,730,612 | 3/1988 | Dampney | 128/201.24 |
| 4,752,974 | 6/1988 | Haino | 2/424 |
| 4,901,716 | 2/1990 | Stackhouse et al. | 128/201.25 |
| 4,986,282 | 1/1991 | Stackhouse et al. | 128/857 |
| 4,999,846 | 3/1991 | Ball et al. | 2/5 |
| 5,054,480 | 10/1991 | Bare et al. | 128/201.25 |
| 5,283,914 | 2/1994 | James | 2/424 |

FOREIGN PATENT DOCUMENTS

| | | | |
|---|---|---|---|
| 1017797 | 12/1952 | France | 2/418 |
| 2744488 | 4/1978 | Germany | 128/201.25 |
| 986429 | 1/1983 | U.S.S.R. | 128/201.29 |
| 1068130 | 1/1984 | U.S.S.R. | 128/201.22 |
| 94/03235 | 2/1994 | WIPO | 128/201.24 |

*Primary Examiner*—V. Millin
*Assistant Examiner*—William J. Deane, Jr.
*Attorney, Agent, or Firm*—Richard L. Myers

[57] ABSTRACT

The disclosed air filtration system filters both entering and exiting air. A primary structural element of the air filtration system is the unitary helmet member, which fits over the user's head. The unitary helmet member includes both a front aperture near the user's forehead and a rear aperture near the upper rear portion of the user's head. The unitary helmet member is blow-molded and therefore simple in construction. An interior channel connects the front aperture to the rear aperture, and a fan located over the rear aperture circulates air between these two apertures. A hood filter and a face shield fit over the unitary helmet member. The hood filter filters air passing through the rear aperture, and further filters air passing through a rear portion of the hood filter. Only the single fan is needed to draw air into the hood filter and remove air from the hood filter. The fan is placed over the rear aperture, thus distributing weight on the upper rear portion of the user's head to reduce stress and fatigue of the user. A secondary filter for added performance may be placed under the hood filter or over the fan inlet surface. A middle aperture located on the unitary helmet member between the front and rear apertures provides for a venting function to allow warm air to pass to the top of the user's head before exiting through the hood filter.

20 Claims, 4 Drawing Sheets

SURGICAL HELMET

BACKGROUND OF THE INVENTION

1. Field of the Invention

The present invention relates generally to an air filtration system and, more particularly, relates to an air-filtration system to be worn over a user's head that filters air moving in and out of the air-filtration system.

2. Background of the Invention

Many personal air-filtration devices have been proposed by the prior art. Most of these devices include a helmet and a complicated air-filtering and circulating system. The manufacturing costs of most of these systems is high. Prior art air-filtration systems which are heavy or cumbersome significantly reduce the performance of the user. For example, a physician may experience an attenuated range of vision or an attenuated range of motion from helmets with small viewing windows or bulky designs. The weight of the helmet for a personal air-filtration system must be as low as possible to reduce fatigue and stress associated with a lengthy surgical procedure being performed by a physician. Even technicians in semi-conductor chip manufacturing clean rooms, for example, need personal air-filtration systems which are not heavy, complex, limiting in motion or vision, and which are affordable. An effective design which does not reduce the user's performance is needed.

U.S. Pat. No. 5,054,480 to Bare et al., issued on Oct. 8, 1991, discloses an air flow filtration control system to be worn by a user when a controlled air flow and air-filtration environment is required or desired. The personal air-filtration system includes a system of air passages for circulating air. At least one intake fan is located near the top of the helmet, and an exhaust fan is located near the bottom rear of the helmet. The majority of air is moved only through the air passages, and specific filters are placed over each of the intake and exhaust fans. The helmet of this system is cumbersome, complicated, and is also heavy due to the large number of individual air passages and fans.

Another helmet air-filtration system is disclosed in U.S. Pat. No. 4,901,716 to Stackhouse et al., issued on Feb. 20, 1990. This system is designed for use in a clean room, and pulls outside air into the helmet for filtration. The air entering the helmet is not filtered, but a number of flapper valves prevent contaminants from the wearer and this unfiltered air from leaving the helmet. Air is filtered as it is exhausted out of the helmet through powered filter systems. Such a system could not provide protection to a physician, since air entering the system is not filtered.

U.S. Pat. No. 3,525,334 to Braman et al. discloses a garment assembly to prevent personnel contamination from entering a working environment. The garment assembly includes a helmet, jacket and pants, and is described as being suited for use in clean rooms and similar low contamination areas.

A helmet-mounted air conditioning system is described in U.S. Pat. No. 5,193,347 to Apisdorf. This apparatus includes a heat absorption side and a heat dissipation side, but does not filter air entering the helmet or exiting the helmet. None of these prior art air filtration systems provide a comfortable, lightweight air-filtering system of simple and economical design. Nor do any of the prior art systems provide a vent hole located near the top the helmet for allowing warm air from the user's head, breath, or the fan mechanisms, for example, to escape therethrough.

SUMMARY OF THE INVENTION

The air filtration system of the present invention simply and efficiently filters entering and exiting air. A primary structural element of the air filtration system is the unitary helmet member, which fits over the user's head. The unitary helmet member includes both a front aperture near the user's forehead and a rear aperture near the upper rear portion of the user's head. Other apertures in addition to, or as an alternative to, the front aperture may be included to add, for example, air flow to the side or back of the head. The unitary helmet member is molded and therefore simple and economical in construction.

An interior channel connects the front aperture to the rear aperture, and a fan located over the rear aperture moves air between these two apertures. A hood filter and a face shield fit over the unitary helmet member. The hood filter filters air passing through the rear aperture, and further filters air passing through a rear portion of the hood filter.

Only the single fan is needed to draw air into the hood filter and remove air from the hood filter. The fan is placed over the rear aperture. This location properly distributes weight on the upper rear portion of the user's head to thereby reduce stress and fatigue of the user. A secondary filter may be used in addition to the hood filter for added filtration performance, and may be placed under the hood filter or over the rear aperture.

A middle aperture located on the unitary helmet member between the front and rear apertures but not connected to the interior channel provides for a venting function to allow warm air to pass to the top of the user's head before exiting through the hood filter.

The unitary helmet member is light weight, simple in design, and can be manufactured at a relatively low cost using a blow-molded procedure. The unitary helmet member fits over the upper portion of the user's head, and provides a bicycle-helmet type fit for comfort and user convenience.

In addition to the lightweight unitary helmet member, the use of only a single fan for drawing air into and out of the air filtering system reduces noise and weight, and further increases reliability due to fewer moving parts. Additionally, a single battery pack can power the air filtration for longer than prior art devices, since a single fan draws less power.

This fan is detachably secured over the rear aperture using a detachable member. The detachable member can accommodate a secondary filter, for enhanced filtering capabilities.

The middle aperture located between the front and rear apertures allows the user to access an optional adjustable crown strap while the unitary helmet is on. This allows the user to adjust the crown strap through the middle aperture without removing the air filtration system.

DETAILED DESCRIPTION OF THE PREFERRED EMBODIMENT

Figure 1:
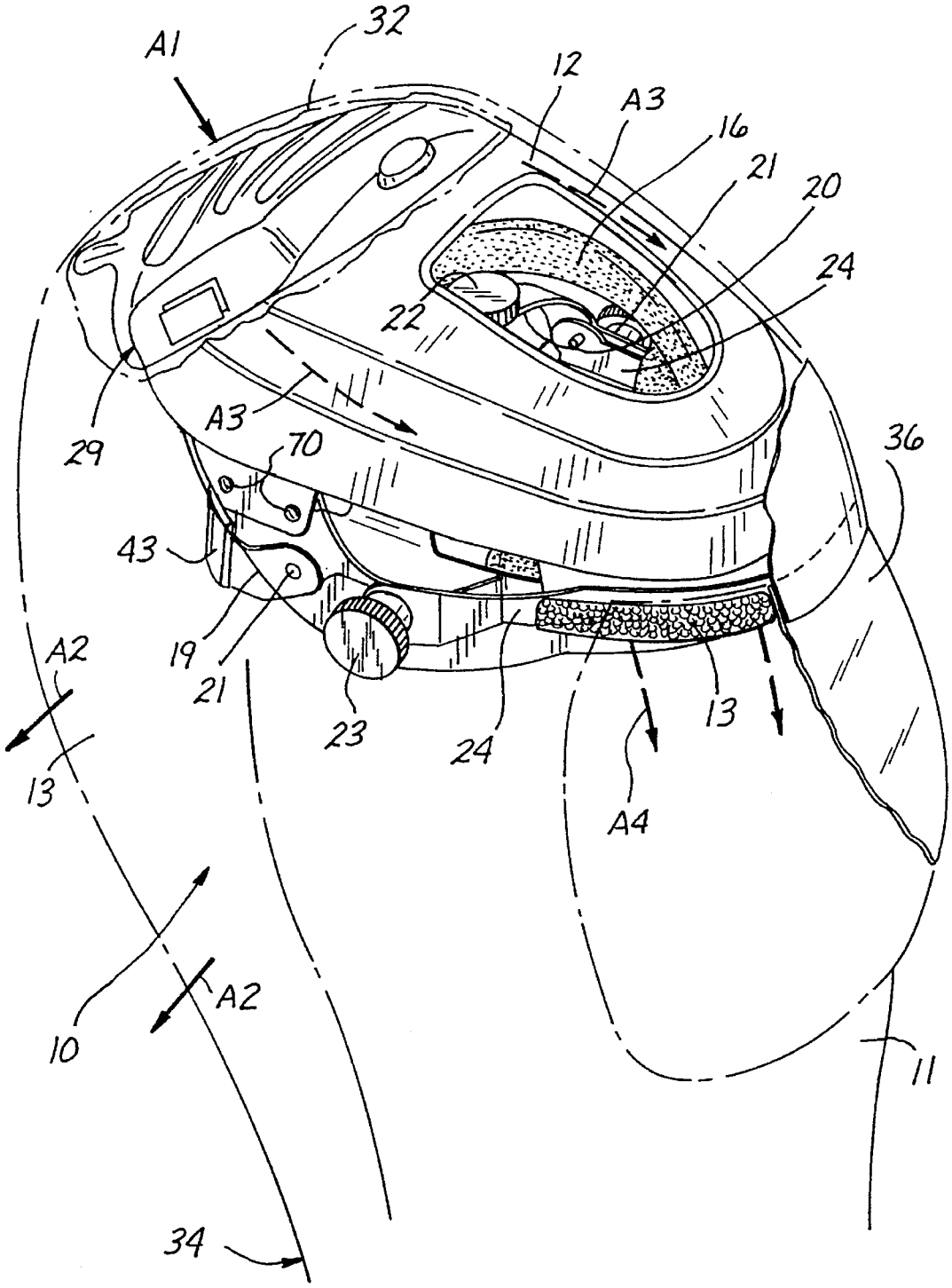
FIG. 1 is a perspective view of the air filtration system of the presently preferred embodiment.

Turning to FIG. 1, the air filtration system 10 is illustrated with both a hood filter 34 and a bonnet filter 32 attached thereto. Either the hood filter 34 or the bonnet filter 32 may be used separately, or these two filters may be used together for maximum filtration. The hood filter 34 comprises a front half formed of impermeable material 11, a face shield 36, and a rear half formed of a permeable filter media 15. Air enters into the air filtration system 10 through an upper portion of the permeable filter media 13 in a direction of arrow A1, and exits the air filtration system 10 through remaining portions of the permeable filter media 15 in the direction of the arrows A2.

The air filtration system 10 generally comprises a unitary helmet member 12, which may be molded into a single piece. The unitary helmet member 12 is blow-molded in the presently preferred embodiment but may also be injection molded or vacuum formed, for example. The hood filter 34 and a bubble-shaped face shield 36 fit over the unitary helmet 12. In an alternative embodiment, the face shield may be flat or semi-curved. The unitary helmet member 12 includes a securing means for securing the hood filter 34 to the unitary helmet member 12. In the presently preferred embodiment, the securing means comprises a hook-and-loop fastener 13 located near the front of the unitary helmet member 12. Thus, the hood filter 34 is placed over the unitary helmet member 12 and secured to the hook-and-loop fastener 13.

The bottom portion of the hood filter 34 fits around the user's neck. This bottom portion may be expandable to stretch over the unitary helmet member 12 and the user's head, or the hood filter 34 may separate partially to allow for a close fit over the unitary helmet member 12. Conventional means for separating and reattaching the hood filter 34, such as a hook-and-loop fastener, zippers, or buttons, may be used.

Figure 2:
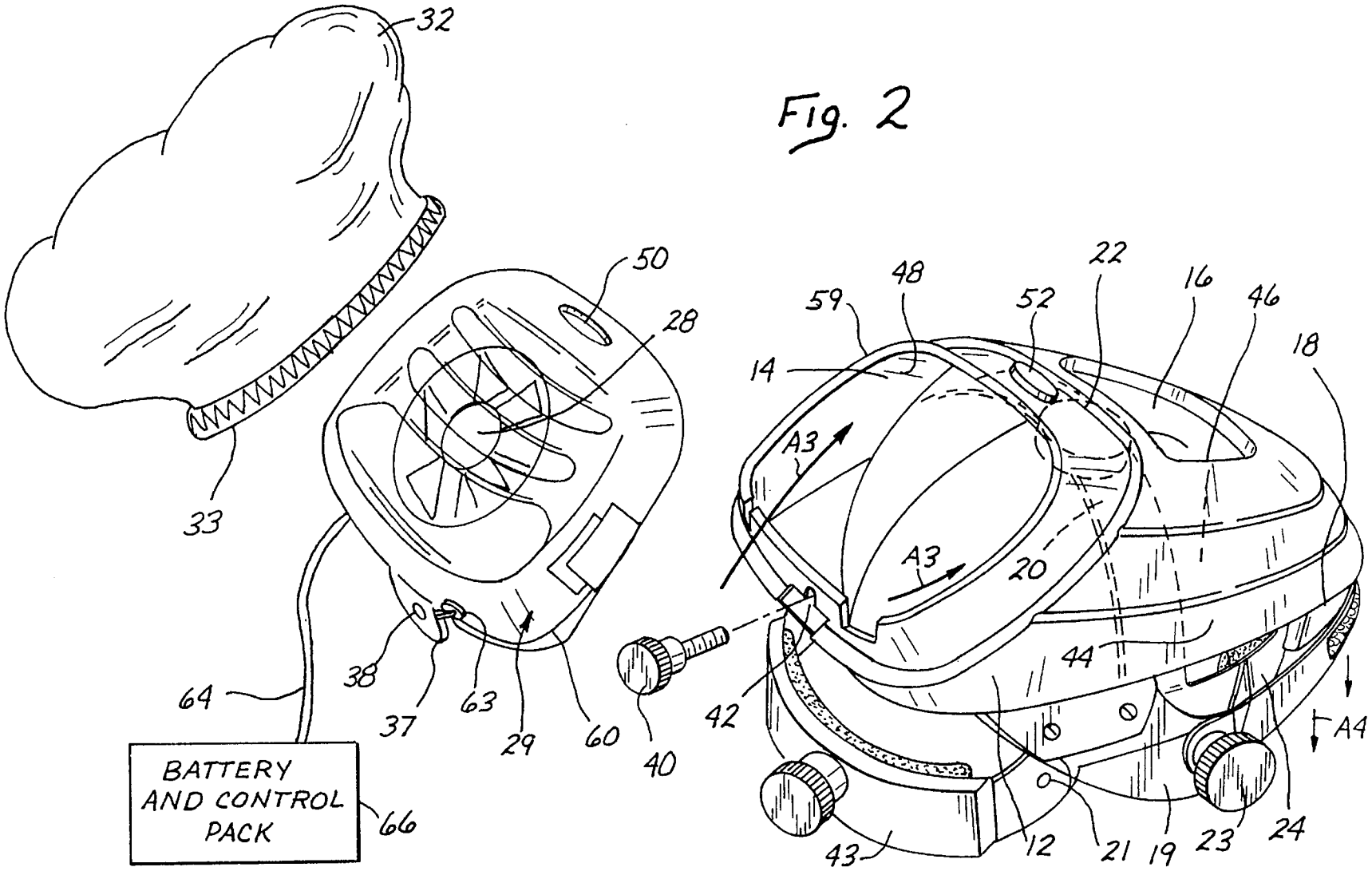
FIG. 2 is a partially disassembled perspective view of the air filtration system of a preferred embodiment.
Figure 3:
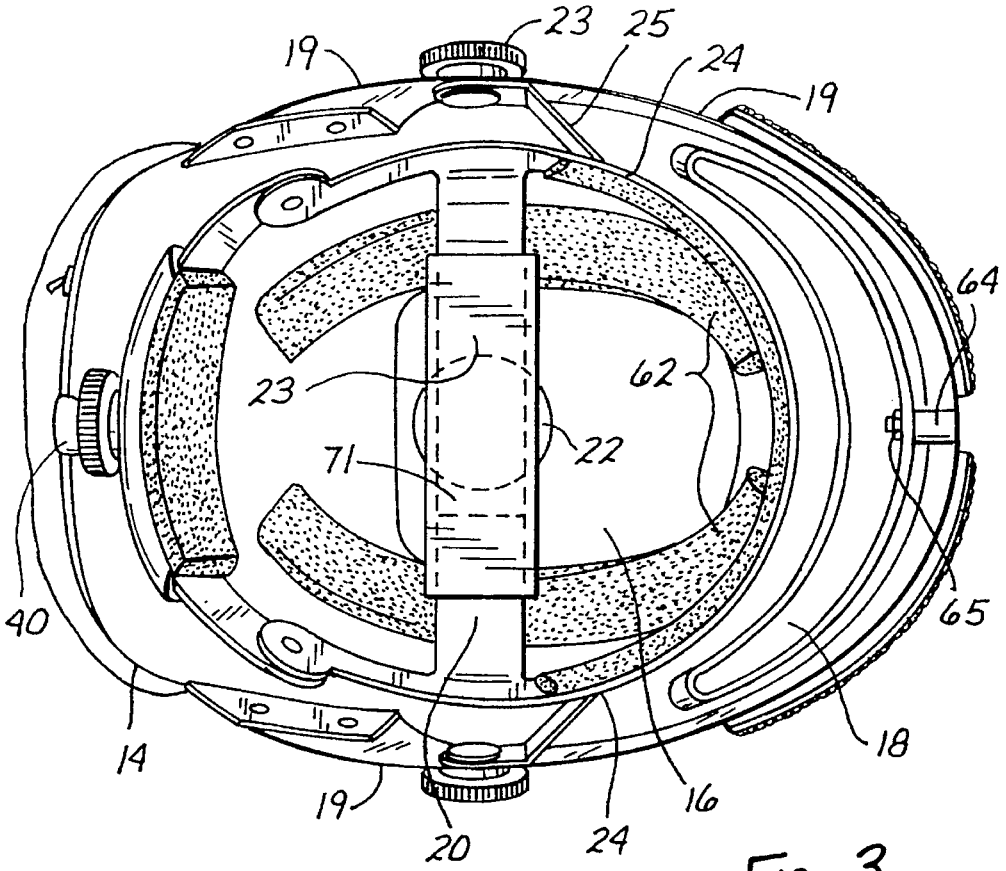
FIG. 3 is a bottom perspective view of the air filtration system of the present invention without the face shield and hood filter.

The unitary helmet member 12 includes a rear aperture 14 (FIG. 2), a middle aperture 16, and a front aperture 18 (FIG. 3). A portion of the unitary helmet member 12 between the rear aperture 14 and the front aperture 18 is hollow to thereby provide air routing means. Air passing through the upper portion of the permeable filter media 15 in the direction of arrow A1 passes through the rear aperture 14, and travels through the air routing means in the direction of arrow A3. The air thus divides around the middle aperture 16 and converges near the front of the unitary helmet member 12, before passing down and through the front aperture 18. Air passing through the front aperture 18 travels down over the user's face in the direction of arrow A4.

A detachable member 29 fitting onto the rear of the unitary helmet member 12 houses a fan 28 (FIG. 2). The fan 28 preferably has a forward or reverse mode, and also offers two speeds of rotation. In the forward mode, the fan 28 draws air through the permeable filter media 13 in the direction of A1, through the rear aperture 14, and through the air channelling means in a direction of arrow A3. The air passing through the rear aperture 14 is thus filtered by the permeable filter media 13 and, further, may be filtered by the bonnet filter 32 when the bonnet filter 32 is used for extra filtering. If extra filtering is not desired, the air filtration system 10 may used without the bonnet filter 32.

As shown in FIG. 2, the detachable member 29 is secured to the unitary helmet member 12 via a securing knob 40. Specifically, a tab or knob 52 of the unitary helmet member 12 fits into the aperture 50 of the detachable member 29, and the tab 37 fits into the slot 42. The securing knob 40 then fits through an aperture 38 in the tab 37 and through an aperture (not shown) in the unitary helmet member 12. Other means, such as a hook-and-loop fastener, for example may be used (instead of the securing knob 40, tab 52, aperture 50, tab 37, and slot 42) for detachably securing the detachable member 29 to the unitary helmet member 12.

A perimeter 59 of the unitary helmet member 12 is smaller than a corresponding perimeter 60 of the detachable member 29. When the detachable member 29 fits over the perimeter 59 of the unitary helmet member 12, the perimeter 60 forms a groove around the rear portion of the unitary helmet member 12. The bonnet filter 32 comprises an elastic strap 33 for fitting into the groove formed by the perimeter 60. In addition to providing a means for fastening the bonnet filter 32 over the rear aperture 14 of the unitary helmet member 12, the detachable member 29 also allows for easy access to the fan 28 and associated components for repair and maintenance. When detached from the helmet the detachable member 29 allows the unitary helmet member 12 to be submersed for easy cleaning, as presently embodied.

In the presently preferred embodiment, a rocker speed switch 63 is located on the detachable member 29 to provide convenient switching between high and low speeds of the fan 28. A power cord 64 provides power from the battery and control pack 66 to the detachable member 29. The battery and control pack 66 preferably comprises a 4.8 volt NiCad battery pack with four 1.2 volt batteries in series. The battery and control pack 66 further comprises two output jacks for power cords 64, a charging jack, an on/off switch, and several LEDs for indicating states of the battery and control pack, such as "charging" and "ready." The battery and control pack 66 preferably comprises a fastening means for attaching to the belt or other convenient area of the user.

The rear aperture 14 (FIG. 2) connects the outside surface 44 (FIG. 2) of the unitary helmet member 12 to the interior surface 48 (FIG. 2) of the unitary helmet member 12. The air routing means 30 is generally formed by interior surfaces 48. The front aperture 18 (FIG. 3) connects the interior surface 48 to both the inside surface 46 and the outside surface 44 of the unitary helmet member 12.

Unlike the front aperture 18 and the rear aperture 14, the middle aperture 16 is sealed from the interior surface 48. This middle aperture 16 provides a venting function for air heated from the user's breath, user's head, or from the fan 28 and associated components. Any warm air can thus pass through the middle aperture 16 and out of the permeable filter media 13. Advantages of this middle aperture 16, for example, are to reduce the weight of the unitary helmet member 12 and also to reduce perspiration of the user's head when wearing the unitary helmet member 12.

Another advantage of the middle aperture 16 is to allow the user to reach through the middle aperture 16 and grasp the adjustable joining member 22, without removing the unitary helmet member 12, to thereby adjust the length of this crown strap 20. The adjustable joining member 22 connects left and right portions of a crown strap 20.

The crown strap 20 contacts the upper portion of the user's head, and is attached to a forehead strap 24. The crown strap 20 is rotatably secured to the forehead strap 24 via the pivot 21, which preferably comprises a rivet. A rear strap 43 contacts the rear of the user's head. The forehead strap 24, the rear strap 43, and the crown strap 20 may be removed from the air filtration system 10 to reduce the overall weight of the air filtration system 10 and to provide for a different fit. Since the forehead strap 24 is attached to the air filtration system 10 by the friction knob 23, this friction knob 23 can be removed to thereby remove the forehead strap 24, the rear strap 43, and the crown strap 20. The friction knob 23 may also be moved vertically in a vertical slot, or among a plurality of vertically spaced apertures, to thereby move the forehead strap 24, the rear strap 43, and the crown strap 20 vertically to accommodate different user-head sizes. This configuration allows for the presently preferred embodiment, where the crown strap 20 is not used.

The friction knob 23 fits through an aperture (not shown) in an outer arm 25 (FIG. 3) of the forehead strap 24. A plurality of apertures may be placed in the face shield support 19 to provide for various securing positions of the outer arm 25 to the air filtration system 10. The friction knob 23 secures the outer arm 25 to the air filtration system 10 by also fitting into an aperture (not shown) in the face shield support 19 (FIG. 4).

The hook-and loop fastener 13 fits onto the face shield support 19. The face shield support 19 is preferably non-transparent but may, in an alternative embodiment, comprise a transparent material for increasing a range of vision of the user. For example, the air filtration system 10 may be used without the hood filter 34, but with the bonnet filter 32 and a separate face shield 46 attached directly to the hook-and-loop fastener 13. In this configuration, the face shield support 19, which is secured to the unitary helmet member 12 by two nearby nuts and bolts 70 or, alternatively by rivets, for example, does not obstruct the range of the user.

Turning to FIG. 3, a face shield support pin 64 connected to the face shield support 19 is inserted through an aperture in the unitary helmet member 12 and secured thereto using a bolt 65 or, alternatively, a rivet. In the presently preferred embodiment, the face shield support 19 is integrally formed with the unitary helmet member 12. As shown in FIG. 3, a forehead pad 25 is secured to the forehead strap 24 using a hook-and-loop fastener, for example. Two upper head pads 62 are similarly secured to upper inside portions of the unitary helmet member 12. A crown strap pad 71 is similarly secured to the strap accommodating means 23 of the adjustable joining member 22.

Figure 4:
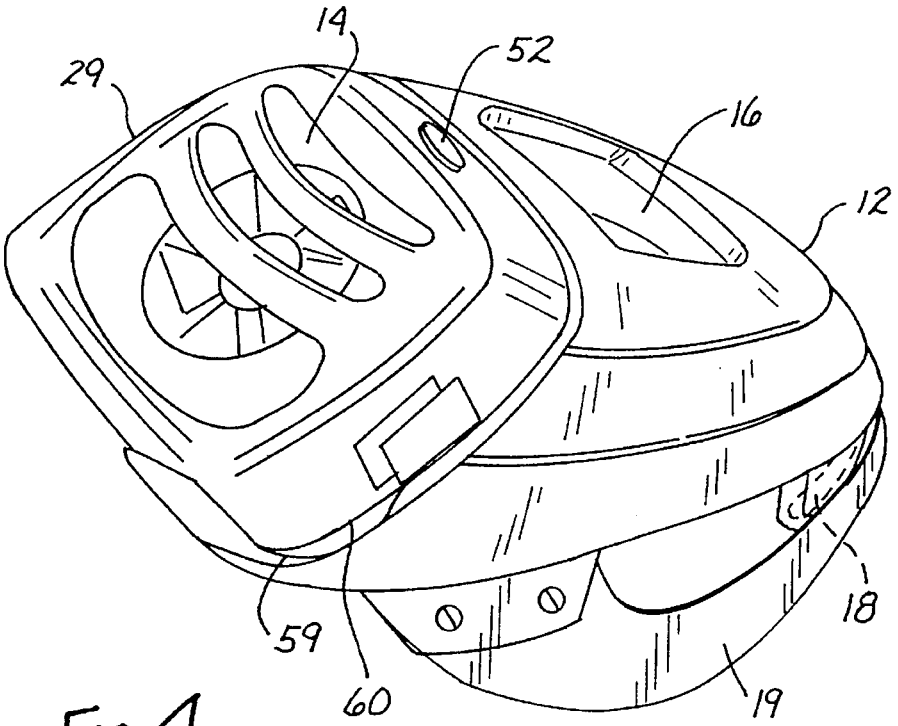
FIG. 4 is a perspective view of the unitary helmet member of the air filtration system according to a preferred embodiment.

FIG. 4 illustrates the unitary helmet member 12, which is molded according to the present invention. The unitary helmet member 12 is shown attached to both the face shield support 19 and the detachable member 29. According to the presently preferred embodiment, blow-molding of the unitary helmet member 12 into the illustrated shape provides manufacturing efficiency and functional versatility.

The unitary helmet member 12 provides lightweight, versatile, and comfortable operating modes. Positioning of the rear aperture 14 near the rear of the unitary helmet member 12 places the weight of the fan and fan components at a center of gravity of a physician's head when the physician is operating. This placement of the rear aperture 14 reduces the problem of forward and rearward tilting of prior art helmets due to shifting of the center of gravity relative to the user's head when the user looks up or down. The bicycle fit of the unitary helmet member 12, in combination with the placement of the fan in the rear aperture 14, allows the air filtration system 10 to be comfortably and effectively used without the crown strap 20. The middle aperture 16 reduces the weight of the unitary helmet member 12 and, further, significantly increases the strength of the unitary helmet member 12.

Moreover, for applications where high filtering is not required, the bonnet filter 32 may be used alone without the hood filter 34. In this configuration the bonnet filter 32 is placed over the rear aperture 14 to provide a stream of filtered air down across the user's face. The face shield may or may not be used. The user will often desire to use the face shield, however, for added protection. Other configurations of the present invention, including use of the hood filter 34, may be implemented by the user according to preference.

Since the bonnet filter 32 is removably attached to the detachable member 29, various bonnet filters 32, each having a different filtration characteristic, may be interchangeably used with the air filtration system 10 of the present invention.

Figure 5:
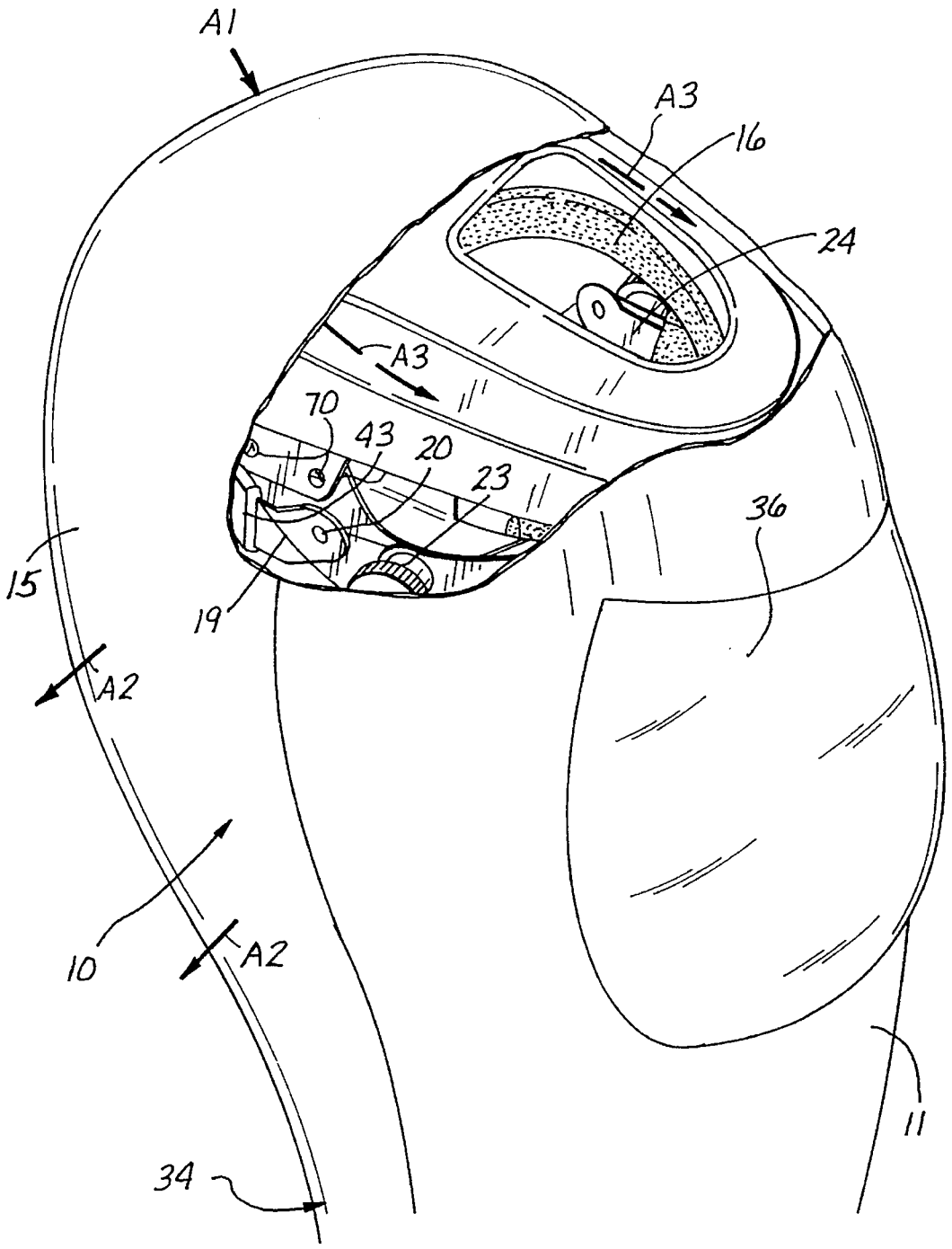
FIG. 5 shows the air filtration system of the presently preferred embodiment.

FIG. 5 shows the air filtration system 10 with both the rear strap 43 and the face shield support 19, but without the crown strap 20. This utilization of only the rear strap 43 and the face shield support 19 is the presently preferred embodiment. The air filtration system 10 of the present invention provides splash shield or face mask level filtration. This air filtration system 10 protects both the user and the patient. The air filtration system of the presently preferred embodiment provides a minimum of six hours of uninterrupted battery use when powered with a Nickel-Cadmium (NiCad) battery pack. Moreover, togas may be used in place of the hood filter 34, and detachable members 29 may be carried separately for easy replacement in the field.

The single fan 28 of the air filtration system 10 provides for a much longer life of the product using a single battery, since this fan 28 is used for both air intake and air exhaust. The positive pressure created by the inward flow of air through the rear aperture 14 forces heated air around the user's head and out of the permeable filter media 13. Exiting air only passes from the permeable filter media 13 in the rear of the hood filter 34 and, thus, the impermeable material 11 in the front of the hood filter 34 substantially prevents air from exiting over the patient. The unique location of this impermeable material in the front of the hood filter 34 also provides for added splash protection. The bonnet filter 32, when used in combination with the hood filter 34, provides a high level of filtration. A large variety of levels of filtration are available according to the present invention, depending on the combination of the hood filter 34, the bonnet filter 32, and the respective materials used for both.

Although exemplary embodiments of the invention have been shown and described, many changes, modifications and substitutions may be made by one having ordinary skill in the art without necessarily departing from the spirit and scope of this invention.

We claim:

1. An air filtration system to be worn on a user's head, comprising:

(a) a unitary helmet member for generally covering an upper portion of the user's head, the unitary helmet member including (1) a middle aperture for positioning over a top middle portion of the user's head, the middle aperture connecting an outside surface of the unitary helmet member to an inside surface of the unitary helmet member, (2) a rear aperture for positioning over a top rear portion of the user's head, the rear aperture connecting the outside surface of the unitary helmet member to an interior surface of the unitary helmet member, and (3) a front aperture for positioning over a front portion of the user's head, the front aperture connecting the interior surface of the unitary helmet member to both the inside surface and the outside surface of the unitary helmet member;

(b) an air filter extending across the rear aperture;

(c) a forehead strap including (1) a left end connected at a left connecting point for positioning near a left side of the user's head, and (2) a right end connected at a right connecting point for positioning near a right side of the user's head, the left end and the right end together spanning from the left connecting point to the right connecting point to extend across a forehead of the user;.

(d) air routing means, for routing air between the rear aperture and the front aperture, the air routing means routing air around the middle aperture and being defined by interior surfaces connecting the front aperture and the rear aperture; and (e) air circulating means, positioned in the rear aperture of the unitary helmet member, for circulating air between an outside of the air filtering system and the air routing means, the air circulating means circulating air through the air filter in the rear aperture, through the air routing means, through the front aperture, and over the user's face, to thereby filter air and circulate air over the user's face.

2. The air filtration system to be worn on a user's head according to claim 1, wherein the unitary helmet member is blow molded.

3. The air filtration system to be worn on a user's head according to claim 1, further comprising a crown strap including:

(1) a left strap having a first end coupled to the left connecting point and a second end for extending up to and over the top middle portion of the user's head; and (2) a right strap having a first end coupled to the right connecting point and a second end for extending up to and over the top middle portion of the user's head.

4. The air filtration system to be worn on a user's head according to claim 3, the crown strap further including:

(3) an adjustable joining member for positioning at the top middle portion of the user's head and adjustably connecting the second end of the left strap to the second end of the right strap near the top middle portion of the user's head, the adjustable joining member adjustably changing a length of the crown strap between the left connecting point and the right connecting point according to a user's manipulation of the adjustable joining member.

5. The air filtration system to be worn on a user's head according to claim 4, wherein the adjustable joining member is accessible through the middle aperture to allow the user to adjust the crown strap without removing the air filtration system from the user's head.

6. The air filtration system to be worn on a user's head according to claim 1, wherein the filtering means located across the rear aperture comprises a bonnet, and wherein any of a plurality of bonnets, each having different filtering characteristics, may be removable attached across the rear aperture.

7. The air filtration system to be worn on a user's head according to claim 6, further comprising a face shield detachably connected to the unitary helmet member near the front aperture.

8. The air filtration system to be worn on a user's head according to claim 1, further comprising a hood filter fitting over the unitary helmet member, the hood filter including a first permeable portion positioned over the rear aperture for filtering air passing through the rear aperture and a second permeable portion for positioning at the back of the user's head to filter air passing behind the user's head.

9. The air filtration system to be worn on a user's head according to claim 8, wherein the air circulating means operates in a first mode to draw air through the hood filter, through the air filter, into the air routing means, out of the front aperture, down across the user's face, toward the back of the user's head, and out of the rear portion of the hood filter.

10. The air filtration system to be worn on a user's head according to claim 9, wherein the air circulating means operates in a second mode to draw air in through of the rear portion of the hood filter, toward the user's face, up across the user's face, into the front aperture, through the air routing means, through the air filter, and out of the hood filter.

11. An air filtration system to be worn on a user's head, comprising:

a hood filter having a front half and a rear half, the front half including a face shield and a generally non-permeable flexible material and the rear half including a permeable flexible material having an upper rear portion and an intermediate rear portion, the permeable flexible material acting as a filter;

a unitary helmet member for generally covering an upper portion of the user's head and supporting the hood filter, the unitary helmet member including both a front aperture connecting an interior surface of the unitary helmet member to both an inside surface and an outside surface of the unitary helmet member, and a rear aperture connecting the outside surface of the unitary helmet member to the interior surface of the unitary helmet member;

an interior channel channelling air between the rear aperture and the front aperture, the interior channel defined by the interior surfaces connecting the front aperture and the rear aperture; and a single, two-way fan located in the rear aperture of the unitary helmet member and having a first mode of operation in which the fan rotates in a first direction to create a positive pressure for drawing air through an upper rear portion of the permeable flexible material of the hood filter, through the rear aperture, into the interior channel, out of the front aperture, down across the user's face, and out of an intermediate rear portion of the permeable flexible material of the hood filter, and, a second mode of operation in which the fan rotates in a second direction opposite to the first direction to create a negative pressure for drawing air into the intermediate rear portion of the permeable flexible material of the hood filter, up across the user's face, into the front aperture, and out of the upper rear portion of the permeable flexible material of the hood filter.

12. The air filtration system to be worn on a user's head, according to claim 11, further comprising a forehead strap including a left end connected at a left connecting point and a right end connected at a right connecting point, the left end and the right end together spanning from the left connecting point to the right connecting point to extend across a forehead of the user.

13. An air filtration system to be worn on a user's head, the air filtration system being configurable in order to filter air from a user to avoid introducing contaminants into a sterile environment, the air filtration system comprising:

(a) a unitary helmet member for generally covering an upper portion of the user's head, the unitary helmet member including (1) a front aperture connecting an interior surface of the unitary helmet member to both an inside surface and an outside surface of the unitary helmet member, (2) a rear aperture connecting the outside surface of the unitary helmet member to the interior surface of the unitary helmet member, and (3) a middle aperture located intermediate the front aperture and the rear aperture;

(b) a hood filter covering the unitary helmet member, the hood filter having an upper rear portion spanning over the rear aperture and also having an intermediate rear portion generally below the upper rear portion, both the upper rear and intermediate rear portions comprising permeable flexible material for filtering air passing therethrough;

(c) a bonnet comprising permeable flexible material for filtering air passing therethrough, the bonnet being removably attached over the rear aperture to provide a secondary filtering function in addition to a filtering function performed by the upper rear portion of the hood filter;

(d) an interior channel channelling air between the rear aperture and the front aperture and sealed from the middle aperture, the interior channel defined by interior surfaces connecting the front aperture and the rear aperture; and (e) air circulating means drawing air through the intermediate rear portion of the hood filter, up over the user's face, into the front aperture, through the interior channel, through the rear aperture, through the bonnet, and through the upper rear portion of the hood portion.

14. The air filtration system to be worn on a user's head according to claim 13, further comprising a crown strap including (a) a left strap having a first end connected to the helmet member at a left connection point for positioning near a left side of the user's head and a second end for passing up to and over a top portion of the user's head, (b) a right strap having a first end connected to the helmet member at a right connection point for positioning near a right side of the user's head and a second end for passing up to and over a top portion of the user's head, and (c) an adjustable joining member for positioning at the top middle portion of the user's head to adjustably connect the left strap to the right strap near the top middle portion of the user's head, the adjustable joining member adjustably changing a length of the crown strap according to a user's manipulation of the adjustable joining member.

15. An air filtration system to be worn on a user's head, comprising:

a unitary helmet member for generally covering an upper portion of the user's head, the unitary helmet member including both a front aperture connecting an interior of the unitary helmet member to both an inside surface and an outside surface of the unitary helmet member, and a rear aperture connecting the outside surface of the unitary helmet member to the interior surface of the unitary helmet member;

an interior channel channeling air between the rear aperture and the front aperture, the interior channel defined by interior surfaces connecting the front aperture and the rear aperture;

air circulating means for drawing air through the rear aperture, through the interior channel, through the front aperture, and over the user's face;

a detachable member covering the rear aperture and housing the air circulating means, a perimeter of the detachable member fitting over a perimeter of the rear aperture;

a groove located on the helmet between the perimeter of the detachable member and the perimeter of the rear aperture; and air filtering means fitting around the groove and covering the detachable member.

16. An air filtration system to be worn on a user's head, comprising:

a unitary helmet member for generally covering an upper portion of the user's head, the unitary helmet member including both a front aperture connecting an interior surface of the unitary helmet member to both an inside surface and an outside surface of the unitary helmet member, and a rear aperture connecting the outside surface of the unitary helmet member to the interior surface of the unitary helmet member;

a hood filter covering the unitary helmet member, the hood filter having an upper rear portion spanning over the rear aperture and also having an intermediate rear portion generally below the upper rear portion, both the upper rear and intermediate rear portions comprising permeable flexible material for filtering air passing therethrough;

an interior channel channelling air between the rear aperture and the front aperture, the interior channel defined by interior surfaces connecting the front aperture and the rear aperture;

air circulating means for drawing air through the upper rear portion of the hood filter, through the rear aperture, through the interior channel, through the front aperture, over the user's face, and through the intermediate rear portion of the hood filter; and a middle aperture located near a top portion of the unitary helmet member, the middle aperture operating as a vent hole for warm air to pass up and away from the upper portion of the user's head.

17. An air filtration system to be worn on a user's head, comprising:

(a) a hood filter having a front half and a rear half, the front half including a face shield and a generally non-permeable flexible material and the rear half including a permeable flexible material having an upper rear portion and an intermediate rear portion and acting as a filter;

(b) a unitary helmet member for generally covering an upper portion of the user's head and supporting the hood filter, the unitary helmet member including (1) a front aperture connecting an interior surface of the unitary helmet member to both an inside surface and an outside surface of the unitary helmet member, (2) a rear aperture connecting the outside surface of the unitary helmet member to the interior surface of the unitary helmet member, (3) an interior channel channeling air between the rear aperture and the front aperture, the interior channel defined by the interior surfaces connecting the front aperture and the rear aperture, and (4) a middle aperture located intermediate the front aperture and the rear aperture and sealed from the interior channel; and (c) a fan located in the rear aperture of the unitary helmet member, the fan rotating in a direction to create a positive pressure and to draw air through the upper rear portion of the permeable flexible material of the hood filter, through the rear aperture, into the interior channel, out of the front aperture, down across the user's face, and out of the intermediate rear portion of the permeable flexible material of the hood filter.

18. The air filtration system to be worn on a user's head according to claim 17, further comprising a crown strap, the crown strap including:

(1) a left strap having a first end coupled to a left connecting point and a second end for extending up to and over the top middle portion of the user's head;

(2) a right strap having a first end coupled to a right connecting point and a second end for extending up to and over the top middle portion of the user's head; and (3) an adjustable joining member for positioning at the top middle portion of the user's head to adjustably connect the second end of the left strap to the second end of the right strap near the top middle portion of the user's head, the adjustable joining member adjustably changing a length of the crown strap between the left connecting point and the right connecting point according to a user's manipulation of the adjustable joining member.

19. An air filtration system to be worn on a user's head, comprising:

(a) a unitary helmet member for generally covering an upper portion of the user's head, the unitary helmet including (1) a first aperture for positioning at a first portion of the user's head, (2) a second aperture for positioning at a second portion of the user's head, (3) air routing means, defined by interior surfaces connecting the first aperture and the second aperture, for routing air between the first aperture and the second aperture, and (4) a third aperture, located between the first aperture and the second aperture, and sealed from the interior surfaces;

(b) an air filter located across the first aperture; and (c) air circulating means, positioned in the first aperture of the unitary helmet member, for circulating air between an outside of the air filtering system and the air routing means and for moving air through the air filter in the first aperture, through the air routing means, around the third aperture, through the second aperture, and over the user's face, to thereby filter air and circulate air over the user's face.

20. The air filtration system to be worn on a user's head according to claim 19, wherein the first aperture is located at a top rear portion of the helmet for positioning at a top rear portion of the user's head, and the second aperture is located at a front portion of the helmet for positioning at a front portion of the user's head.

* * * * *